United States Patent [19]

Ohta et al.

[11] 4,041,256

[45] Aug. 9, 1977

[54] OPEN-BACK TYPE HEADPHONE WITH A DETACHABLE ATTACHMENT

[75] Inventors: Kazuho Ohta, Sagamihara; Fumio Matsuda, Machida; Tsutomu Tanaka, Yamato; Katsuhiro Ohnuki; Naotaka Miyaji, both of Tokyo; Hidetoshi Sato, Yamato, all of Japan

[73] Assignee: Victor Company of Japan, Limited, Yokohama, Japan

[21] Appl. No.: 682,165

[22] Filed: Apr. 30, 1976

[30] Foreign Application Priority Data

May 6, 1975 Japan ..... 50-53147

[51] Int. Cl.[2] ..... H04R 1/10

[52] U.S. Cl. ..... 179/182 R

[58] Field of Search ..... 179/156 R, 182, 182 R, 179/180

*Primary Examiner*—William C. Cooper

[57] ABSTRACT

An open-back type headphone comprises a driver unit for operating as a sound generating source, a case accommodating therewithin said driver unit and having a front face on the side to confront and be pressed against an ear of a listener and a back face on the side opposite that of the front face, said back face being acoustically open, an ear pad provided on said front face of the case and forming at the center thereof a front air chamber, and an attachment detachably attached to said back face of the case. The attachment has an open end communicable with the back face of the case and an internal space of a specific volume and is adapted to cover and seal the back face of the case. The attachment and said case have an attaching mechanism by which the attachment can be detachably attached to the case.

7 Claims, 9 Drawing Figures

OPEN-BACK TYPE HEADPHONE WITH A DETACHABLE ATTACHMENT

BACKGROUND OF THE INVENTION

The present invention relates to headphones whose sides opposite the sides to be fitted against the listener's ears, that is, the back sides, are open. More particularly, the invention relates to an open-back type headphone which is so adapted that an attachment for covering the back side thereof can be detachably attached to the back side.

In general, headphones for listening to sounds are of the so-called closed type wherein the backs of the headphone structures, that is, the sides opposite the sides to be fitted against the listener's ears, are closed. In the use of headphones of this closed type, sounds from outside of the headphones are completely shielded off. For this reason, the listener using these headphones is shut off from the outside and is thus subjected to a feeling of isolation, which gives rise to an unnatural sensation and other objectionable features of sound listening.

Accordingly, open-back type headphones, in which their backs are open so that the listener can hear some back or ambient noises also and therefore does not feel isolated, have been proposed and reduced to practice.

These open-back headphones, however, have been accompanied by certain problems. Since some sound leaks out from the headphone structures through the open backs to the outside, this feature becomes a disadvantage in cases where complete prevention of such leakage of sound out of the headphone is desired. Another problem is that, since sounds enter through the open backs of the headphones, sounds being listened to through the headphones are impaired by interference due to noise when excessive noise enters from the outside. Furthermore, in cases such as that where monitoring is being carried out with these headphones as sound is being recorded by means of a tape recorder, the sound from the outside to be recorded, noise, and other sounds are all heard, whereby in some cases the monitoring sound cannot be accurately grasped, and proper control of recording level cannot be achieved.

SUMMARY OF THE INVENTION

Accordingly, it is a general object of the present invention to provide a novel and useful headphone of open-back type in which the above described problems have been overcome.

Another and more specific object of the invention is to provide an open-back headphone which is so constituted that an attachment having a specific internal capacity or volume for covering the back side of the headphone structure is detachably attachable to the back side. By attaching this attachment, the open back of the open-back headphone is tightly closed, and the interior of the headphone is shielded off from the exterior. Since the attachment has a specific internal volume, the sound pressure in the low-frequency range does not drop very much and there is actually almost no deterioration of sound quality even when the headphone is in the state wherein the attachment is attached to its structures.

Still another object of the invention is to provide an open-back type headphone having a mechanism by which the above mentioned attachment can be very easily attached to and detached from the back side of headphone structure.

Other objects and further features of the invention will be apparent from the following detailed description with respect to preferred embodiments of the invention when read in conjunction with the accompanying drawings.

DETAILED DESCRIPTION

Figure 1:
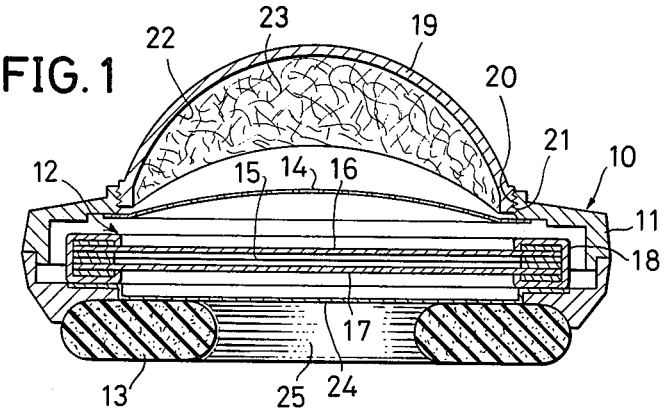
FIG. 1 is a section showing a first embodiment of an open-back type headphone according to the invention, the section being taken in a plane passing through the central axis of the headphone.

Referring first to FIG. 1, the principal parts of the open-back type headphone 10 shown therein are a case 11, a driver unit 12 of electrostatic type accommodated within the case 11, and an ear pad 13 provided on the front side of the case 11, that is, the side to face an ear of a listener, over a protector plate 24. A mesh cover 14 having a large number of perforations is secured across the back of the case 11, but the back of the case is acoustically open.

The electrostatic driver unit 12 is of known type, comprising essentially a vibrating plate 15 having a metal deposited by evaporation on its surface, fixed electrodes 16 and 17 disposed on opposite sides of the vibrating plate in confronting and spaced-apart relation thereto, and a housing 18 fixedly holding these parts as an integral structure. The ear pad is of annular shape and is made of a soft and resilient material.

To cover the back side of this headphone 10, there is provided an attachment 19 of cupola or dome shape having a specific wall thickness of more than 1 mm., for example, and having no holes formed therethrough. This attachment 19 is provided around its outer peripheral edge part at its open end with external screw threads 20, which are screw engaged with internal screw threads 21 formed around the rim of the back opening of the case 11. The attachment 19 is thus screw fastened to the back of the case 11, thereby closing the back side of the case.

By forming the attachment 19 in the form of a dome, a hollow interior 22 of a specific internal volume is provided therewithin. This hollow interior 22 is filled with a damping material 23, which functions to impart loss to the sound radiated into the attachment 19 from the back of the headphone 10, thereby damping this sound and preventing the formation of a standing wave within the hollow interior 22. Materials such as glass wool and ester wool are suitable for use as the damping material 23.

To attach the attachment 19 to the case 11, the screw threads 20 and 21 are engaged, and the attachment 19 is turned in the screwing-in direction. To detach the attachment 19 from the case 11, the attachment 19 is turned in the opposite unscrewing direction until the screw threads 20 and 21 are disengaged.

Figure 2A:
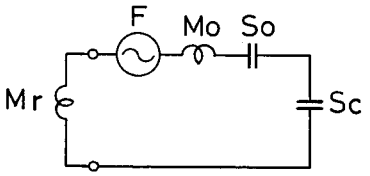
FIGS. 2A and 2B are equivalent circuit diagrams respectively corresponding to the case where an attachment is not attached and the case where an attachment is attached to the headphone illustrated in FIG. 1.
Figure 2B:
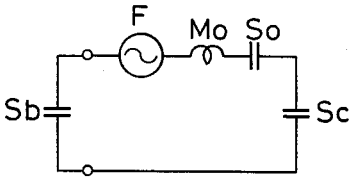

Equivalent circuits of the headphone 10 corresponding respectively to the case where the attachment 19 is detached from and the case where it is attached to the case 11 are shown in FIGS. 2A and 2B. Each of these equivalent circuits has a drive source F comprising the driver unit 12, an equivalent mass Mo and equivalent stiffness So of the vibrating plate 15, and an equivalent stiffness Sc related to the volume of a front air chamber 25. The equivalent circuit in the former case wherein there is no attachment 19 has an equivalent radiation mass Mr of the headphone. The equivalent circuit in the latter case wherein the attachment is attached has an equivalent stiffness Sb related to the internal volume of the attachment.

The sound pressure P when the attachment 19 is attached to the case 11 can be represented by the following equation.

$$P \propto \frac{-\frac{Sc}{\omega}}{\omega Mo - \frac{Sb + Sc + So}{\omega}} F, \quad (1)$$

where $\omega$ represents angular frequency.

Here, since the equivalent stiffness So of the vibration plate 15 and the equivalent stiffness Sc of the front air chamber 25 are respectively of the order of $1 \times 10^3$ N/m and $5 \times 10^4$ N/m in actual practice, the equivalent stiffness So is negligible in comparison with the equivalent stiffness Sc. Furthermore, since the equivalent mass Mo of the vibration plate 15 is below $1 \times 10^{-4}$ kg. in actual practice, it can be neglected also.

Accordingly, the sound pressure P in the medium and low frequency range can be expressed by the following simplification of Eq.(1).

$$P \propto \frac{Sc}{Sc + Sb} F \quad (2)$$

When this Eq.(2) is rewritten with functions in which volumes are used, the following equation is obtained.

$$P \propto \frac{\frac{1}{Wc}}{\frac{1}{Wc} + \frac{1}{Wb}} F \quad (3)$$

Here, Wc is the volume of the front air chamber 25, and Wb is the volume of the internal space 22 of the attachment 19.

The state wherein there is no attachment 19 corresponds to Wb = $\infty$. Therefore, by attaching the attachment 19 and providing a finite Wb, the above sound pressure P is lowered. However, as described hereinbelow, when the volume Wb of the attachment 19 is selected at a value above a certain value, the lowering of the sound pressure does not become a great problem from the practical standpoint even when the attachment 19 is attached.

Figure 3:
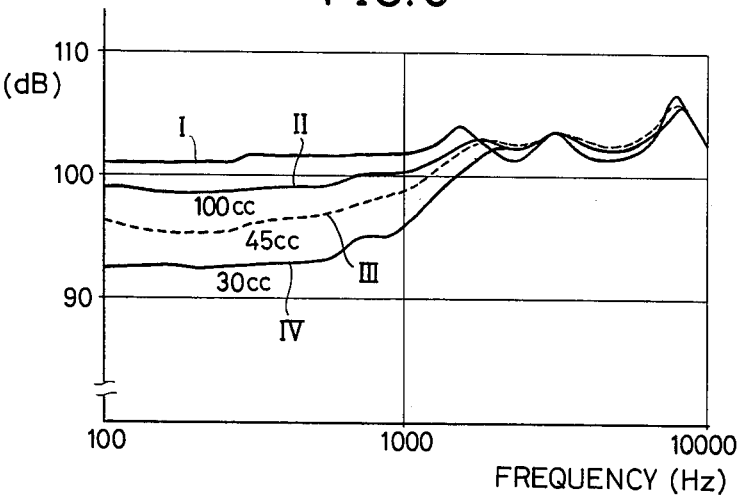
FIG. 3 is a graph indicating the frequency characteristics of sound pressure for different internal volumes of the attachment.

An example of frequency characteristics of sound pressure for different volumes of the attachment 19 is shown in FIG. 3. Curve I indicates the sound pressure characteristic in the case where the attachment 19 is not attached, while curves II, III, and IV respectively indicate the sound pressure characteristics in cases where attachments of internal volumes Wb of 100cc, 45cc, and 30cc are attached. The volume of the front air chamber 25 in all of these cases is 45cc. The curves in FIG. 3 were obtained from actually measured values, which are substantially in agreement with values calculated by inserting the values of the internal volumes of the attachment 19 into the above derived Eq.(3).

While the sound pressure level decreases with decrease in the volume of the attachment 19, it was found as a result of actual listening tests with headphones to which attachments of different volumes were attached that the limiting minimum volume Wb of the attachment 19 which will not result in a great deterioration of the sound quality and sound pressure for practical purposes is of the order of 40cc to 45cc. Accordingly, in the instant embodiment, a volume of the attachment 19 of over approximately 45cc is desirable. Furthermore, while the desirable volume Wb of the attachment 19 depends also on the kind of headphone 10, it is desirable that it be at least greater than a value of the order of the volume Wc of the front air chamber 25.

Furthermore, in an actual specific example wherein the volume Wb of the attachment 19 was 94cc, and the volume Wc of the front air chamber 25 of the headphone 10 was 28cc, the lowering of the sound pressure in the medium and low frequency range with the attachment 19 in attached state was 2.3 dB in comparison with the case where the attachment 19 was not attached.

In addition, it was confirmed that, in the case where the attachment 19 is made of a stainless steel material of a thickness of 1.5 mm., for example, the shielding off effect due to the attachment 19 is approximately 26dB.

Accordingly, in the case where some back noises of the surroundings can be permitted to enter, the headphone 10 may be used in a state that the attachment 19 is detached therefrom. In this case, the headphone 10 operates as an ordinary headphone of the known open-back type, functioning well without any lowering whatsoever of sound pressure.

Then, in the case where the headphone listener wishes to shut out completely sound from the surroundings or wishes to prevent reproduced sound of the headphone from leaking out of the headphone, the attachment 19 is attached to the case 11 as described above. By thus attaching the attachment 19, the back of the headphone 10 and the outside can be acoustically shielded from each other. Moreover, the listener can hear sound of excellent sound quality without the accompaniment of a great lowering of sound pressure.

It should be understood that the driver unit is not restricted to the electrostatic type in the above described embodiment, it being possible to use a driver unit of any other appropriate type such as an electrodynamic type, a full-drive electrodynamic type, a magneto-striction type, or a piezo-electric effect type. Furthermore, the means for attaching and affixing the attachment 19 to the case 11 need not be limited to the screw-thread means in the above described embodiment, it being possible to resort to any of other means such as pressure-fitting means and catch or engagement mechanisms.

Figure 4:
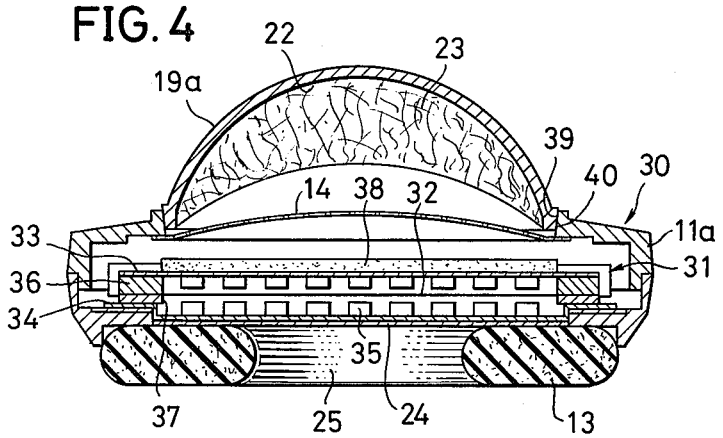
FIG. 4 is a section similar to FIG. 1 showing a second embodiment of the open-back type headphone according to the invention.

Another embodiment of an open-back type headphone constituting a second embodiment of the invention is illustrated in FIG. 4. In FIG. 4, parts which are the same as corresponding parts in FIG. 1 are designated by like reference numerals. These parts will not be described in detail again. In this headphone 30 of the instant embodiment, a driver unit 31 of full-drive electro-dynamic type is used. This driver unit 31 comprises a vibrating diaphragm 32 with voice coil, magnetic short-circuiting plates 33 and 34, magnets 35, a vibrating diaphragm supporting ring 36, and a spacer 37. A damping material 38 is bonded onto the back surface of the driver unit 31. For this damping material, a material such as felt, unwoven fabric, or glass wool may be used.

The headphone 30 of the instant embodiment has an attachment 19*a* of dome shape similar to that of the attachment 19 of the preceding embodiment. The interior space 22 of this attachment 19*a* is also filled with a damping material 23. The outer peripheral part of the attachment 19*a* at its open rim is formed with a tapering external surface 39 converging toward the open end, that is, an external surface of a diameter decreasing toward the open end. The case 11*a* of the headphone 30 at its back open end rim part is provided with a tapering internal surface 40 diverging toward the open end, that is, an internal surface of a diameter increasing toward the open end of the case 11*a*.

To attach the attachment 19*a* to the case 11*a* of the headphone 30, the open end of the attachment 19*a* is inserted with pressing force into the back opening of the case 11*a* so that the external surface 39 of the attachment 19*a* is pressed and fits snugly against the internal surface 40 of the casing 11*a*. These tapered surfaces 39 and 40 are then in tight contact because of the wedge effect of their tapers, and by the resulting frictional resistance, the attachment 19*a* is secured the case 11*a*. To detach the attachment 19*a*, it is simply pulled away from the case 11*a*. A feature of the headphone 30 of the instant embodiment is that the attaching and detaching of the attachment 19*a* to and from the case 11*a* are easier than those of the preceding embodiment.

The attachment can be secured to the case of the headphone by still other means as described below.

Figure 5A:
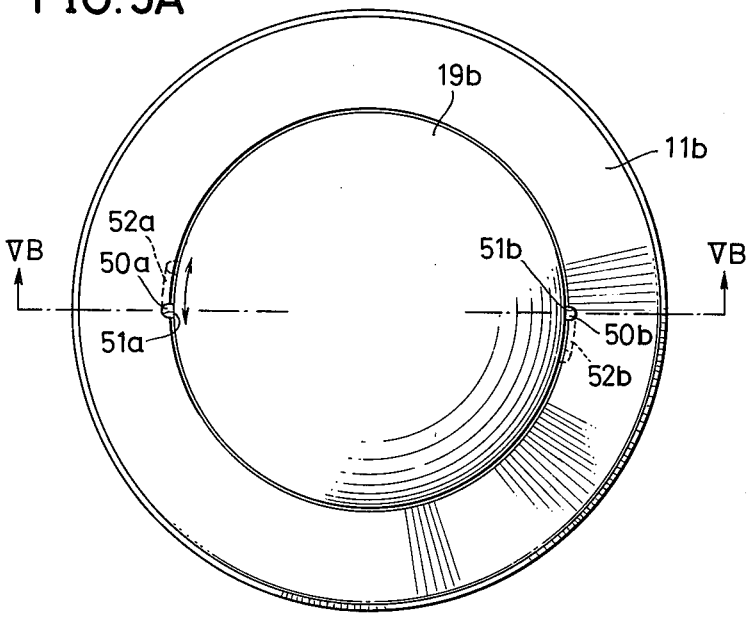
FIGS. 5A and 5B are respectively a plan view and a section taken along the line VB-VB therein showing the essential parts of a third embodiment of the open-back type headphone according to the invention.
Figure 5B:
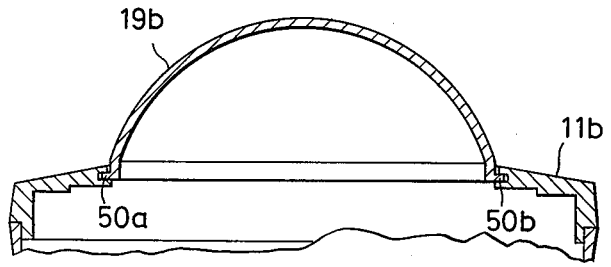

In the embodiment illustrated in FIGS. 5A and 5B, radially outwardly directed projections 50*a* and 50*b* are provided integrally with the attachment 19*b* on the outer side of its open end part at diametrically opposite sides thereof. The case 11*b* is provided at the inner rim of its open back part, at diametrically opposite sides thereof, with grooves 52*a* and 52*b* having openings 51*a* and 51*b* of a size sufficient for insertion thereinto and extraction therefrom of the projections 50*a* and 50*b*.

To affix the attachment 19*b* to the case 11*b*, the projections 50*a* and 50*b* of the attachment 19*b* are fitted into the openings 51*a* and 51*b* of the case 11*b*, and then the attachment 19*b* is rotated in the clockwise direction as viewed in FIG. 5A. As a consequence, the projections 50*a* and 50*b* are caused to move into engagement with the grooves 52*a* and 52*b* of the case 11*b*, whereby the attachment 19*b* is attached to the case 11*b*. To detach the attachment 19*b* from the case 11*b*, the above described procedure is reversed.

Figure 6A:
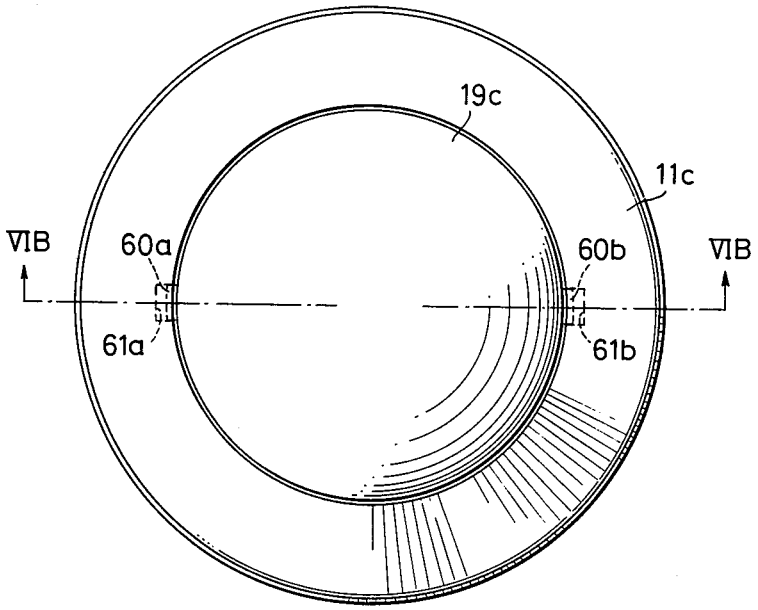
FIGS. 6A and 6B are respectively a plan view and a section taken along the line VIB—VIB therein showing the essential parts of a fourth embodiment of the open-back type headphone according to the invention.
Figure 6B:
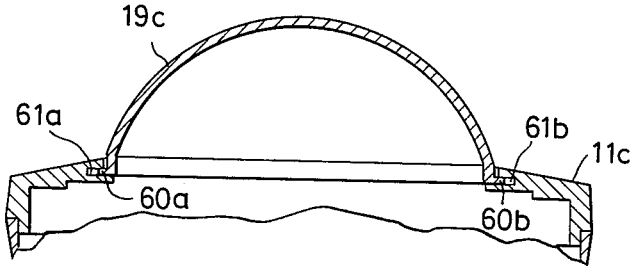

In the embodiment illustrated in FIGS. 6A and 6B, radially outwardly directed projections 60*a* and 60*b* are provided integrally with the attachment 19*c* on the outer side of its open end part at diametrically opposite sides thereof. The case 11*c* is provided at the inner rim of its open back part, at diametrically opposite sides thereof, with recesses 61*a* and 61*b* for receiving the projections 60*a* and 60*b*.

To attach the attachment 19*c* to the case 11*c* either one of the projections 60*a* and 60*b* is fitted into and engaged with one of the recesses 61*a* and 61*b* in the case 11*c*, and the part in the neighborhood of the other projection of the attachment 19*c* is deformed somewhat by pressing this part. This other projections is then fitted into and engaged with the other recess in the case 11*c*. The attachment 19*c* is thereby attached to the case 11*c*. The attachment 19*c* in this state can be detached from the case 11*c* by a reversal of the above described procedure.

Further, this invention is not limited to these embodiments but various variations and modifications may be made without departing from the scope and spirit of the invention.

What is claimed is:

1. An open-back type headphone comprising:

a driver unit for operating as a sound generating source;

a case accommodating therewithin said driver unit and having a front face on the side to confront and be pressed against an ear of a listener and a back face on the side opposite that of the front face, said back face being acoustically open;

an ear pad provided on said front face of the case and forming at the center thereof a front air chamber; and an attachment detachably attached to said back face of the case, said attachment having an open end communicable with the back face of the case and an internal space of a specific volume and being adapted to cover and seal the back face of the case, said attachment and said case having cooperatively an attaching mechanism by which the attachment can be detachably attached to the case.

2. An open-back type headphone as claimed in claim 1 in which said attachment is formed in the shape of a dome.

3. An open-back type headphone as claimed in claim 1 in which the volume of the internal space of the attachment is made at least of the order of the volume of said front air chamber.

4. An open-back type headphone as claimed in claim 1 in which the volume of the internal space of the attachment is made at least of the order of 45cc.

5. An open-back type headphone as claimed in claim 1 in which said attaching mechanism comprises first screw threads formed on the peripheral rim part of the open end of the back face of the case and second screw threads formed on the peripheral rim part of the open end of the attachment for screw engagement with said first screw threads.

6. An open-back type headphone as claimed in claim 1 in which said attaching mechanism comprises a first tapered surface formed around the peripheral rim part of the open end of the back face of the case and a second tapered surface formed around the peripheral rim part of the open end of the attachment and adapted to be pressed into contact and frictional engagement with said first tapered surface by being fitted and pressed together with the open end of the back face of the case.

7. An open-back type headphone as claimed in claim 1 in which said attaching mechanism comprises projections protruding from the peripheral rim part of the open end of the attachment and recesses formed in the peripheral rim part of the open end of the back face of the case and adapted to receive and engage with said projections.

* * * * *